US005847332A

United States Patent [19]

Faraone

[11] Patent Number: 5,847,332

[45] Date of Patent: Dec. 8, 1998

[54] POLYCARBONATE-BASED RADIALLY ARCUATED SPEAKER CONE

[76] Inventor: Alexander Faraone, 464 Byram-Kingwood Rd., Frenchtown, N.J. 08825

[21] Appl. No.: 967,699

[22] Filed: Nov. 10, 1997

[51] Int. Cl.[6] ..... G10K 13/00

[52] U.S. Cl. ..... 181/164; 181/163; 181/167; 181/173

[58] Field of Search ..... 181/157, 163, 181/164, 169, 170, 173, 174; 381/193, 202, 204, 205

[56] References Cited

U.S. PATENT DOCUMENTS

| | | | |
|---|---|---|---|
| 1,757,107 | 5/1930 | Baltzley | 181/173 |
| 1,787,946 | 1/1931 | LaRue . | |
| 4,013,846 | 3/1977 | Krawczak et al. | 181/173 |
| 4,300,655 | 11/1981 | Sakamoto et al. . | |
| 4,655,316 | 4/1987 | Murray | 181/173 |
| 4,881,617 | 11/1989 | Faraone . | |

*Primary Examiner*—Khanh Dang
*Attorney, Agent, or Firm*—Kenneth P. Glynn, Esq.

[57] ABSTRACT

Acoustic speaker cones have a plurality of thin, pie-shaped segments radiating outwardly from their center with each of the segments having an arcuated cross-section. The cones are made of polycarbonate plastic and take the form of being convex towards the center for high frequency cones or of being concave towards its center for larger broad range cones. The present invention is also directed to a system containing both the aforesaid high frequency cone, and an outer broad range cone with similar radial characteristics The segments of the outer cone preferably terminate at a flexible, high sound absorption ring. The center cone fits within a central orifice at the center of the outer cone. The polycarbonate cones have a specific gravity of about 1.10 and about 1.40, having an electrical dissipation factor of about 0.05 to about 0.30 at 60 Hertz, having an electrical dissipation factor of about 1.00 to about 1.25 at $10^6$ Hertz, and having a thermal condutivity of at least 1.2 BTU/hr/ft$^2$/°F./in.

16 Claims, 2 Drawing Sheets

POLYCARBONATE-BASED RADIALLY ARCUATED SPEAKER CONE

BACKGROUND OF THE INVENTION

1. Field of the Invention

The present invention relates to acoustic speakers and particularly to speakers which have cones with arcuated segments which extend radially and are formed of polycarbonate-based plastic. Thus, the present invention is directed to the pursuit of constant wave velocity generation for accurate sound reproduction at utilizing three dimensionally defined cones made of specific plastic materials.

2. Information Disclosure Statement

The function of cones in speakers is well known and it has been accepted that a coil generates sound waves radially over a speaker cone, typically made of material capable of vibration when properly mounted. The cones were originally named as such due to the slightly "conical" configuration.

Early speaker designs are exemplified by U.S. Pat. No. 1,787,946 to LaRue wherein a suspended diaphragm is used. However, conventional acoustic speakers involved diaphragms of the aforesaid basic conical design wherein it radiated outwardly about a coil. Subsequent improvements led to the acoustic diaphragm having a honeycomb cone, e.g. of a plurality of laminated metal foils, the adjacent metal foils being adhered at a regular pitch.

U.S. Pat. No. 4,300,655 to Sakamoto et al describes an acoustical diaphragm which is made of a cone member of elongated web material bent to have a plurality of radial projections sandwiched between upper and lower flat components. It is indicated by the invention therein that increased speaker power is achieved due to model line reshaping. While this patent is concerned with radial sound wave generation it is not directed to the type of system represented by the present invention wherein constant wave velocities are sought at high frequencies utilizing arcuated speaker segments which tend towards flattening as the radial distance increases.

U.S. Pat. No. 4,881,617 to Alexander Faraone describes an acoustic speaker having a cone located about a transducer wherein the cone has a plurality a thin, pie-shaped segments radiating outwardly from the transducer with each of the segments having an arcuated cross-section, thereby creating a concave side and a convex side.

The above-described patent to Alexander Faraone, the inventer herein, is directed to cones having configurations which are concave towards the center whereas the present invention high frequency center cone has other unique and unobvious characteristics, including being convex towards it center, being unistructurally formed and being located about a voice coil support tube in a different manner.

Notwithstanding the prior art, the present invention is neither taught nor rendered obvious thereby.

SUMMARY OF THE INVENTION

The present invention is directed to improved acoustic speaker cones which have a plurality of thin, pie-shaped segments radiating outwardly from their center with each of the segments having an arcuated cross-section. Uniquely, these cones are made of polycarbonate plastic and take the form of being convex towards the center for high frequency cones or of being concave towards its center for larger broad ranged cones. The segments are highly concave toward the center of the cone and less concave with increasing radial distance away from the center of the cone. The width of the segments may increase linearly with radial distance so as to create a constant acoustical resistance radially. In another embodiment, the present invention is directed to a system containing both the aforesaid high frequency cone, and an outer broad range cone with similar radial characteristics. The segments of the outer cone preferably terminate at a flexible, high sound absorption ring. The center cone fits within a central orifice at the center of the outer cone. The polycarbonate cones consisting of polycarbonate film have a specific gravity of about 1.10 to about 1.400, having an electrical dissipation factor of about 0.05 to about 0.30 at 60 Hertz, having an electrical dissipation factor of about 1.00 to about 1.25 at $10^6$ Hertz, and having a thermal conductivity of at least 1.2 BTU/hr/ft$^2$/°F./in. Also, polycarbonates have softening points, e.i. above 270° F., especially above 300° F. as measured as the Vicat Softening Temperature (ASTM D1525).

BRIEF DESCRIPTION OF THE DRAWINGS

The present invention should be more fully understood when the specification herein is taken in conjunction with the drawings appended hereto wherein.

DETAILED DESCRIPTION OF THE PRESENT INVENTION

As mentioned in the Information Disclosure Statement above, the present inventor has received U.S. Pat. No. 4,881,617 which describes unique acoustical speakers utilizing three dimensionally defined radially arcuated cones.

The present invention involves a substantial improvement over the prior art speakers of U.S. Pat. No. 4,881,617 because it was not recognized at that time that a center cone should be formed unistructurally with a reverse configuration (convex towards the center instead of concave towards the center) with no alternative center materials. While the Faraone patent describes the possibility of center cones as diaphragms, dust covers or cones having a similar design to the main cone with a small piece of sound absorbing material as a terminus, it does not recognize the need for unistructurally formed center cones of one consistent material of construction to enhance high frequency, high quality sound generation. In other words, this present invention center cone is devoid of any padding, alternative materials, cushions or other materials and uniquely generates high frequency waves. In fact, the inventor herein created a cone made of metal foil with a center hole with a foam pad therein consistent with line 25 through 37 of column 3 of U.S. Pat. No. 4,881,617 and found that, after years of further development, this center cone created in accordance with his earlier patent was significantly inferior to a present invention center cone. It created some undesirable resonances and could not carry 20,000 cycles Hertz, whereas the present invention high frequency center cone unexpectedly overcame both of these difficulties. Also, it was not discovered for some years and until very recently that center cones an the original U.S. Pat. No. 4,881,617 broad range cones could be substantially improved, made for less expensively and otherwise defy basic principles of speaker cone construction by being formed of polycarbonate-based plastics.

The high frequency center cone of the present invention may be used alone or with other speakers by being mounted within a central orifice of other speaker configurations. Likewise, the broad range larger cone may be used alone by being mounted about a coil support. In some preferred embodiments, the high frequency center cone of the present invention is combined with the present invention larger broad range cone (outer cone) to create a high quality, extremely broad range, acoustical speaker.

Figure 1:
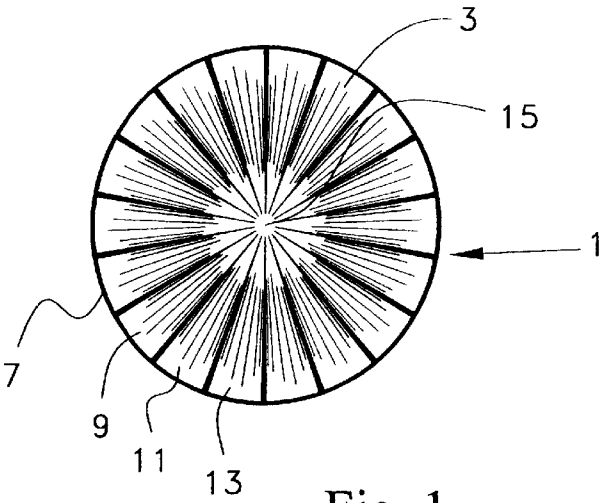
FIGS. 1 and 2 show front and side views of one preferred embodiment of a present invention high frequency center cone.
Figure 2:
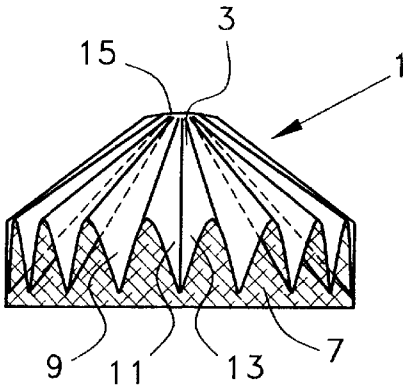

Referring now to FIGS. 1 and 2, there is shown a front view and a side view, respectively, of a present invention high frequency center cone 1. Center cone 1 is formed of clear polycarbonate plastic, known as Lexan® Film 8010 and produced by General Electric Company of Pittsfield, Mass. (Lexan is a registered trademark of General Electric Company). Center cone 1 includes a front portion 3 which is generally convex towards its center (in other words, its most outwardly protruding aspect away from a speaker coil or transducer would be at its center). At the outer edge 5 of front portion 3 is a tubular wall 7, which maintains a circumferential base of support to front portion 3 and enhances attachment of center cone 1 to other components of an acoustical speaker system, such as a tubular support and/or an outer speaker. Individual segments, such as segments 9, 11 and 13 are pie-shaped segments which radiate outwardly from the center 15 of cone 1. All of these segments have an arcuated cross-section as clearly illustrated in FIG. 2, thereby creating a concave side and a convex side to each such segment. All of the concave sides face one direction and all of the convex sides of the segments face an opposite direction. Further, all of the arcuated segments have a highly concave cross-section toward the cone's center 15 and a less concave cross-section with increasing radial distance away from the center 15. Also, as can be seen, cone 1 itself is convex towards its center 15, i.e. it protrudes outwardly away from its wall 7.

Figure 3:
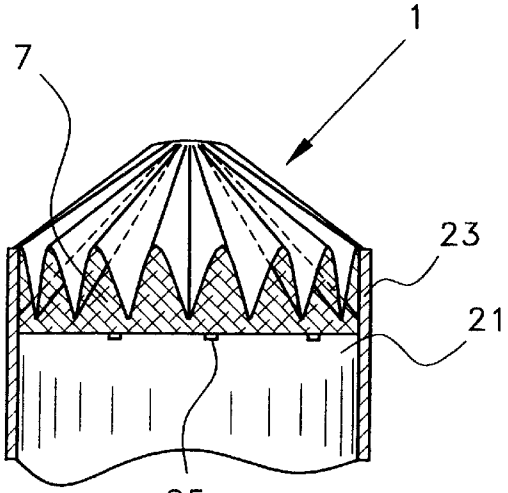

FIG. 3 shows a side view of present invention center cone's mounted on the inside or outside of a tubular support for a speaker coil. In both FIGS. 3 and 4, center cone 1 is mounted to a speaker coil tubular support. In FIG. 3, center cone 1 is inserted on the inside of tubular support 21 with wall 7 of cone 1 being fitted on the inside of wall 23 of tubular support 21. Optional stops such as stop 25 may be used to position center cone 21 at the full depth of wall 7. It may otherwise be kept in place by adhesives and/or the mechanical structure of a speaker cabinet or encasement.

Figure 4:
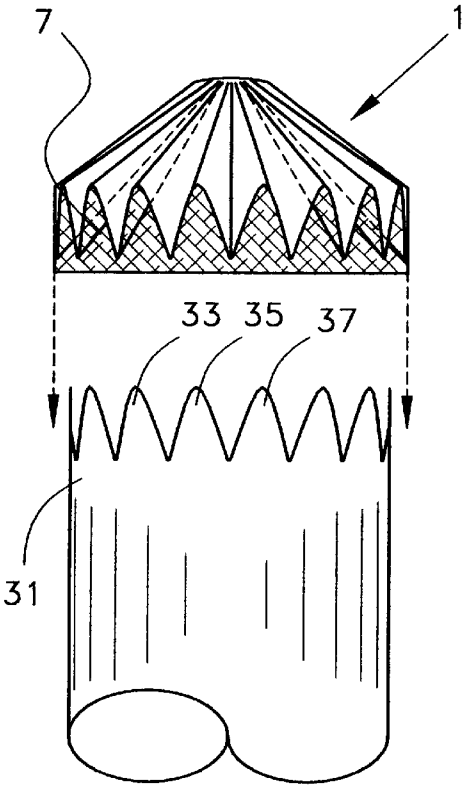
FIGS. 3 and 4 show side views of present invention center cones mounted on the inside and outside of a tubular support for a speaker coil, respectively.

Alternatively, in FIG. 4, cone 1 is fitted to the outside of tubular support 31. In this case, tubular support 31 has an arcuated end with extensions 33, 35, 37, etc. to fit inside wall 7 and mesh with the wall portions which terminate the individual segments of center cone 1. This will permit maximum transmission of the sound waves from the tubular support 31 to center cone 1.

Figure 6:
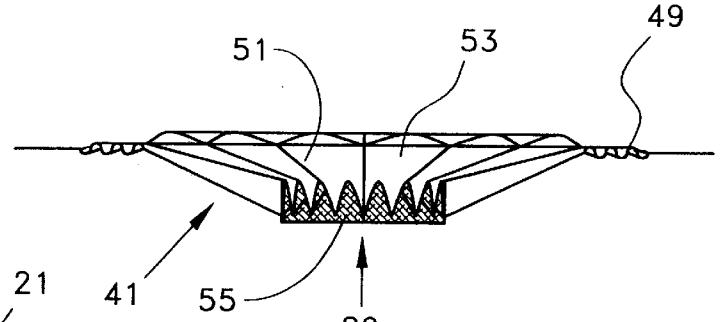
FIG. 6 illustrates a side cut view of a present invention broad range outer cone shown in FIG. 5; and, FIG. 7 illustrates a side cut view of a present invention acoustic speaker, including a center cone and an outer cone.
Figure 5:
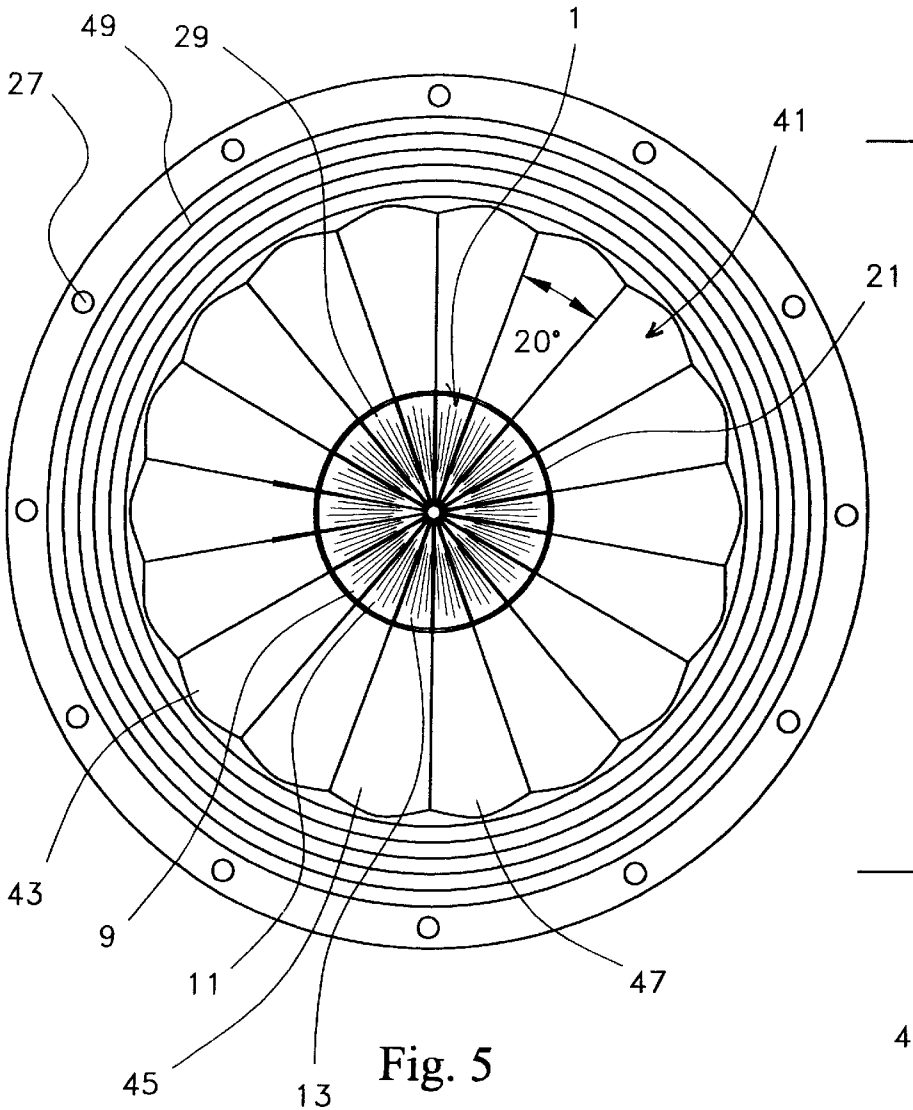
FIG. 5 shows a front view of a present invention speaker arrangement utilizing both the center cone and the outer cone.

FIG. 5 illustrates a front view of a present invention speaker arrangement utilizing center cone 1, as well as outer cone 41. With respect to outer cone 41 reference is made to both FIGS. 5 and 6. FIG. 6 shows a cut side view of present invention outer cone 41 which may be used alone or in conjunction with center cones. FIG. 5 shows center cone 1 located on the inside of a speaker coil tubular support 21 and outer cone 41 located on the outside of tubular support 21. In this embodiment, outer cone 41 has individual segments evenly divided at 20° each and, hence, has a total of 18 segments. Likewise, center cone 1 has 18 corresponding segments. Outer cone 41 contains segments which have an arcuated cross-section, thereby creating a concave side and a convex side to each such segment, all of said concave sides of said segments facing one direction and all of said convex sides of said segments facing an opposite direction. Further, these arcuated segments, such as segments 43, 45 and 47, have a highly concave section towards the center and a less concave cross-section with increasing radial distance away from its center. This is particularly evident when viewing segments 51 and 53 of outer cone 41 shown in FIG. 6.

Figure 7:
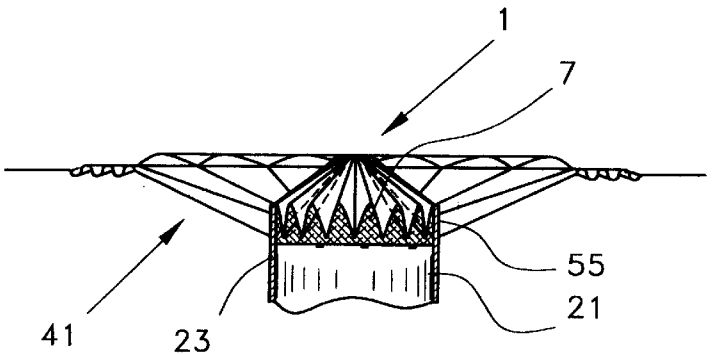

While center cone 1 is convex towards its center as illustrated in FIG. 2, outer cone 41 is concave towards its center as shown in FIG. 6, i.e. outer cone 41 protrudes backwardly towards its center. Additionally, outer cone 41 has an optional high sound absorption suspension ring 49 to permit more motion of outer cone 41 to thereby enhance performance. Mounting to a frame may be accomplished by screws through orifices such as orifice 27. Importantly, note that outer cone 41 has a central orifice 29 and an inside side wall 55 (FIG. 6). In this particular embodiment, outer cone 41 is made of the same material as inner cone 1. FIG. 7 shows a side cut view of the combination acoustic speaker shown in FIG. 5. (Identical parts throughout all of the Figures are identically numbered.)

The present invention cones are made of polycarbonate plastic. Polycarbonates are recognized products defined as thermoplastic linear polyesters of carbonic acid. These materials are commercially available and are known to the plastics artisan.

The inventor herein, over many years, attempted to use various plastics which would function properly for speaker cones utilizing his radially arcuated segmented cones. Requirements included proper acoustics, i.e. sound wave propagation, proper flexibility and rigidity, proper density and acceptable heat dissipation. Originally, the broad range speaker was constructed of aluminum foil and it was recognized that plastics could be used in its place to reduce costs and eliminate electrical conductivity. Although various plastics were tested, none achieved the results of the aluminum foil and it was believed that none would surpass aluminum, until the recent, unexpected results achieved with polycarbonates of selected properties.

Thus, the present invention is directed to polycarbonate cones of the aforesaid arcuated segment arrangements wherein the resulting formed cone of polycarbonate has a specific gravity of about 1.10 to about 1.40, and preferably about 1.15 to about 1.35; has an electrical dissipation factor of about 0.05 to about 0.30 at 60 Hertz and about 1.00 to 1.25 at $10^6$ Hertz; and has a thermal conductivity of at least 1.2 BTU/hr//ft$^2$/°F./in.

The following examples are representative of the present invention cones:

EXAMPLE 1

A high frequency center cone was constructed in accordance with FIGS. 1 and 2 above utilizing a commercially available product of polycarbonate with flame retardant. It outperformed similar aluminum foil devices and all other plastics tested. It has the following characteristics:

| Parameter | Detail |
|---|---|
| Material | Polycarbonate (Lexan ® Flame Retardant Film FR60 (8060) - General Electric Company) |
| Opacity | Clear |
| Thickness | 0.010 in. |
| Segments | 18 |
| Angle (Slope of Segment) | 43.5° up from horizon (side view) |
| Specific Gravity (ASTM D792) | 1.32 |
| Thermal Conductivity (ASTM C177) | 1.35 BTU/hr/ft$^2$/°F./in. |
| Electrical Dissipation Factor (ASTM D150) | |
| at 60 Hz | 0.26 |
| at $10^6$ Hz | 1.17 |

EXAMPLE 2

The cone shown in the FIGS. 1 and 2 made of non-flame retardant polycarbonate has the following characteristics:

| Parameter | Detail |
|---|---|
| Material | Polycarbonate (Lexan ® Film 8010 - General Electric Company) |
| Opacity | Clear |
| Thickness | 0.010 in. |
| Segments | 18 |
| Angle (slope of segment) | 43.5° up from horizon (side view) |
| Specific Gravity (ASTM D792) | 1.20 |
| Thermal Conductivity (ASTM C177) | 1.35 BTU/hr/ft$^2$/°F./in. |
| Electrical Dissipation Factor (ASTM D150) | |
| at 60 Hz | 0.10 |
| at $10^6$ Hz | 1.10 |

EXAMPLE 3

A full range cone as shown in FIG. 6 has the following characteristics:

| Parameter | Detail |
|---|---|
| Material | Polycarbonate (Lexan Film 8010 - General Electric Company) |
| Opacity | Clear |
| Thickness | 0.015 in. |
| Segments | 18 |
| Angle (slope of segment) | 26° down from horizon (side view) |
| Specific Gravity (ASTM D792) | 1.32 |
| Thermal Conductivity (ASTM C177) | 1.35 BTU/hr/ft$^2$/°F./in. |
| Electrical Dissipation Factor | |

-continued

| Parameter | Detail |
|---|---|
| (ASTM D150) | |
| at 60 Hz | 0.26 |
| at $10^6$ Hz | 1.17 |

These cones of Examples 2 and 3 also outperformed cones made of aluminum foils and other plastics tested, including polyvinyl chlorides and polyesters. Polyethylenes and polypropylenes cannot dissipate heat adequately. Some plastics used for bass speakers cannot carry a full range of sound waves.

Obviously, numerous modifications and variations of the present invention are possible in light of the above teachings. It is therefore understood that within the scope of the appended claims, the invention may be practiced otherwise than as specifically described herein.

What is claimed is:

1. In an acoustic speaker having a cone for conversion of electromechanical energy to high frequency sound, the improvement which comprises:

a cone having a plurality of thin, pie-shaped segments which radiate outwardly from the center of said cone, all of said segments having an arcuated cross-section, thereby creating a concave side and a convex side to each such segment, all of said concave sides facing one direction and all of said convex sides of said segments facing an opposite direction, and wherein all of said arcuated segments have a highly concave cross-section toward the cone's center and a less concave cross-section with increasing radial distance away from said center, and further wherein said cone is convex towards said center;

wherein said cone is formed of a plastic consisting of polycarbonate film having a specific gravity of about 1.10 to about 1.40, having an electrical dissipation factor of about 0.05 to about 0.30 at 60 Hertz, having an electrical dissipation factor of about 1.00 to about 1.25 at $10^6$ Hertz, and having a thermal conductivity of at least 1.2 BTU/hr/ft$^2$/°F./in.

2. The acoustic speaker of claim 1 wherein said cone and its segments are all made from a single continuous sheet of unistructurally formed plastic.

3. The acoustic speaker of claim 1 wherein the arcuated segments have a lessening concave cross-section with increasing radial distance from the center of the cone whereby the width of the segment increases linearly with increasing radial distance so as to create constant acoustical resistance radially.

4. The acoustic speaker of claim 1 which further includes a hollow tubular speaker support, and said cone is fitted inside said support at an outer end of said support.

5. The acoustic speaker of claim 1 wherein said specific gravity is about 1.15 to about 1.35.

6. In an acoustic speaker for having a cone for conversion of electromechanical energy for sound, the improvement which comprises:

a.) a first cone, being a center cone, said center cone having a plurality of thin, pie-shaped segments which radiate outwardly from the center of said cone, all of said segments having an arcuated cross-section, thereby creating a concave side and a convex side to each such segment, all of said concave sides facing one direction and all of said convex sides of said segments facing an opposite direction, and wherein all of said arcuated segments have a highly concave cross-section toward the cone's center and a less concave cross-section with increasing radial distance away from said center, and further wherein said cone is convex towards said center; and, b.) a second cone, being an outer cone, said outer cone having a central orifice, and said outer cone being concave towards its center, said outer cone having a plurality of thin pie-shaped segments which radiate outwardly from said transducer, each of said segments having an arcuated cross-section, thereby creating a concave side and a convex side to each such segment, all of said concave sides of said segments facing one direction and all of said convex sides of said segments facing an opposite direction, and further wherein said arcuated segments have a highly concave cross-section towards center and a less concave cross-section with increasing radial distance away from its center;

wherein said first cone is centrally located within said central orifice of said second cone; and, wherein each of said first cone and said second cone are formed of a plastic consisting of polycarbonate film having a specific gravity of about 1.10 to about 1.40, having an electrical dissipation factor of about 0.05 to about 0.30 at 60 Hertz, having an electrical dissipation factor of about 1.00 to about 1.25 at $10^6$ Hertz, and having a thermal conductivity of at least 1.2 BTU/hr/ft$^2$/°F./in.

7. The acoustic speaker of claim 6 wherein said segments of said outer cone terminate at a flexible, high sound absorption suspension ring.

8. The acoustic speaker of claim 6 wherein said center cone and its segments are all made from a single continuous sheet of unistructurally formed plastic.

9. The acoustic speaker of claim 6 wherein said outer cone and its segments are all made from a single continuous sheet of unistructurally formed plastic.

10. The acoustic speaker of claim 6 wherein said specific gravity is about 1.15 to about 1.35.

11. In an acoustic speaker having a center, having a transducer located at said center and having a cone for conversion of electromechanical energy to sound located about said transducer, the improvement which comprises:

a cone having a plurality of thin, pie-shaped segments which radiate outwardly from said transducer, each of said segments having an arcuated cross-section, thereby creating a concave side and a convex side to each such segment, all of said concave sides of said segments facing one direction and all of said convex sides of said segments facing an opposite direction, and further wherein said arcuated segments have a highly concave cross-section at the transducer and a less concave cross-section with increasing radial distance from the center of the speaker;

wherein said cone is formed of a plastic consisting of polycarbonate film having a specific gravity of about 1.10 to about 1.40, having an electrical dissipation factor of about 0.05 to about 0.30 at 60 Hertz, having an electrical dissipation factor of about 1.00 to about 1.25 at $10^6$ Hertz, and having a thermal conductivity of at least 1.2 BTU/hr/ft$^2$/°F./in.

12. The acoustic speaker of claim 1 wherein said specific gravity is about 1.15 to about 1.35.

13. The acoustic speaker of claim 11 wherein the arcuated segments have a lessening concaveness with increasing radial distance from the center of the speaker whereby a width of the segment increases linearly with increasing radial distance so as to create constant acoustical resistance radially.

14. The acoustic speaker of claim 11 wherein said segments terminate at a flexible, high sound absorption suspension ring.

15. The acoustic speaker of claim 11 wherein said speaker may be used for vertical mounting and all segments have the convex surface facing outwardly.

16. The acoustic speaker of claim 14 wherein said speaker may be used for vertical mounting and all segments have the convex surface facing outwardly.

* * * * *